US006767681B2

(12) United States Patent
Fyson

(10) Patent No.: US 6,767,681 B2
(45) Date of Patent: Jul. 27, 2004

(54) PROTECTION OF PHOTOGRAPHIC MATERIAL

(75) Inventor: John R. Fyson, London (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/437,126

(22) Filed: May 13, 2003

(65) Prior Publication Data

US 2003/0215757 A1 Nov. 20, 2003

(30) Foreign Application Priority Data

May 15, 2002 (GB) ..... 0211049

(51) Int. Cl.[7] ..... G03C 5/26; G03C 7/30
(52) U.S. Cl. ..... 430/30; 430/498; 430/933
(58) Field of Search ..... 430/498, 933, 430/30

(56) References Cited

U.S. PATENT DOCUMENTS

| | | | | |
|---|---|---|---|---|
| 3,185,571 A | | 5/1965 | Thiers et al. | 430/608 |
| 3,748,138 A | | 7/1973 | Bissonette et al. | 430/376 |
| 4,895,786 A | * | 1/1990 | Kurematsu et al. | 430/139 |
| 5,508,151 A | * | 4/1996 | O'Toole et al. | 430/393 |
| 5,525,516 A | | 6/1996 | Krutak et al. | 436/56 |
| 5,534,395 A | * | 7/1996 | Kamada et al. | 430/400 |
| 5,643,728 A | | 7/1997 | Slater et al. | 435/6 |
| 5,717,381 A | | 2/1998 | Jagielinski et al. | 340/551 |
| 5,811,152 A | | 9/1998 | Cleary | 427/8 |
| 6,153,365 A | * | 11/2000 | Goswami et al. | 430/455 |
| 6,345,104 B1 | | 2/2002 | Rhoads | 382/100 |
| 6,556,698 B1 | | 4/2003 | Diano et al. | 382/132 |
| 6,632,594 B2 | * | 10/2003 | Nakai et al. | 430/486 |

FOREIGN PATENT DOCUMENTS

| | | |
|---|---|---|
| EP | 0 287 073 | 10/1988 |
| EP | 0 789 270 | 8/1997 |
| EP | 0 938 416 | 10/2001 |
| GB | 1286111 | 8/1972 |
| WO | 98/21046 | 5/1998 |

* cited by examiner

*Primary Examiner*—Hoa Van Le

(57) ABSTRACT

A method of processing photosensitive materials in which one or more chemical compounds are at least partially retained after processing. The chemical compounds are unique to a particular process used by a copyright owner. The absence of the unique compounds in a processed material thus indicates that the processing has been without the authorization of the copyright owner.

3 Claims, No Drawings

PROTECTION OF PHOTOGRAPHIC MATERIAL

CROSS REFERENCE TO RELATED APPLICATIONS

This is a U.S. original patent application which claims priority on Great Britain patent application No. 0211049.2 filed May 15, 2002.

FIELD OF THE INVENTION

This invention relates to the field of the protection of photographs from unauthorized copying, i.e. copying that does not have the copyright owner's consent.

BACKGROUND OF THE INVENTION

The copying of photographs by parties that do not have the copyright owner's permission is a problem. Unauthorized copying results in the loss of potential revenue from the possible legal sale of the photographs.

This copyright 'theft' can be prevented in many ways. The photographic print could be marked in a unique way such as by the signing of the print by the copyright owner or the application of a unique visual identification mark. However, these methods may easily be forged by someone skilled in copying as they are readily seen. In addition, a visible marking might detract from the image. The image might be marked covertly, in a way that cannot be seen without the appropriate tool. If the image is digitally produced, the marking can be done by including a code in the digitization that is not visible in the final print when viewed by the eye, but can be detected electronically. Such methods are practiced by Digimarc Inc., disclosed in e.g. U.S. Pat. No. 6,345,104. Another method is to include a series of dots in the image that can only be detected electronically or by a skilled viewer. Such a method is disclosed in EP 0789270.

The invention aims to provide a method which can detect whether a print or film has been processed at an authorized site, i.e. authorized by the copyright owner. Processing at an authorized site uses unique chemistry to process the print. Identification of the presence of the unique chemistry indicates that the prints are printed with copyright consent. Any prints which did not show the presence of the unique chemistry would be shown not to have been processed at an authorized site and unauthorized use would be established.

SUMMARY OF THE INVENTION

According to the present invention there is provided a method of processing a photosensitive material in which at least one of the processing solutions includes one or more chemical compounds which are at least partially retained in the material after processing is complete, the structure and composition of the compounds being unique to a particular process used by a particular copyright owner.

Preferably, but not necessarily, the chemical compounds are added to the stabilizer or wash solution.

The present invention allows a print to be linked with a particular processing establishment or even a particular processing machine.

It is possible for the method of the invention to be used for motion picture prints as well as conventional prints.

The invention is almost impossible to "reverse engineer". Analysis of the processed material will not give the proportion of chemicals added, i.e. the proportion left is not directly derivable from what goes in.

DETAILED DESCRIPTION OF THE INVENTION

The invention uses unique chemistry in the processing of a film or print. Each authorized processing site has its own unique chemistry which remains in the photographic material after processing. The unique chemistry would be known and used only at authorized sites. Therefore any unauthorized copying would not involve the use of the unique chemistry. Thus if the unique chemistry could not be detected in a print it would be very likely that infringement of copyright had taken place. The unique chemistry composition and samples are kept at a secure location. This could, for example, be with the seller of the chemistry, an impartial party or by the copyright owner. The chemistry can be a mixture of organic or inorganic compounds. It can also be a mixture of organic and inorganic compounds. The compounds are chosen so that they do not detract from the quality of the image and do not effect the stability thereof. However, if it is desired to produce a print having a limited life the compounds need not have the latter quality.

As described above, the unique chemistry remains in the photographic material after processing. The chemistry can be added at any point in the processing. The simplest way would be to add the chemistry to the stabilizer or final wash bath. In this way the chemicals would dry out in the photographic material in the drier. Thus it would not be essential for the chemicals to adhere chemically to the gelatin. Alternatively the chemicals could be added to a processing bath prior to the wash. However in this case the chemicals would have to be able to adhere to emulsion layers and not be subsequently washed out.

The set of unique chemicals would be ones that would not be expected to be found in a normal process. For example they may be a mixture of metal complexes not normally found in processing solutions. The complexes should be chosen to have little color in the concentrations used and to have no effect on image stability. Very dilute metal ions complexed with a suitable ligand such as EDTA would be an example.

The following examples describe enabling embodiments.

EXAMPLE 1

A series of Kodak™ Ektaprint Prime™ stabilizers were made containing trace amounts of complexed metal ions, the metal ions chosen such that in the concentrations used would not be expected to be found in photographic prints. This was done by adding 10 ml of the each of the following additive solutions to separate 250 ml aliquots of Kodak™ Ektaprint Prime™ stabilizer made up as recommended.

| Solution A | |
|---|---|
| demineralized water | 30 ml |
| $Na_4EDTA$ | 0.5 g |
| 1000 ppm strontium standard solution | 1 ml |
| 1000 ppm nickel standard solution | 5 ml |
| 1000 ppm chromium standard solution | 5 ml |
| water to | 50 ml |
| **Solution B** | |
| demineralized water | 30 ml |
| $Na_4EDTA$ | 0.5 g |
| 1000 ppm strontium standard solution | 1 ml |
| 1000 ppm chromium standard solution | 5 ml |
| water to | 50 ml |

-continued

| Solution C | |
|---|---|
| demineralized water | 30 ml |
| $Na_4EDTA$ | 0.5 g |
| 1000 ppm strontium standard solution | 1 ml |
| water to | 50 ml |

Sheets of Kodak™ Ektacolor Edge 8 color photographic paper that had previously been processed with a standard image in a minilab were rewashed in water for 1 minute to re-swell the emulsion layers and then treated with modest agitation, in dishes containing the stabilizers with additives added as described above. Paper was also treated in this way with no additive added as a control.

The sheets were then blotted gently with paper towels to remove surface liquid and allowed to dry at room temperature.

This concludes the treatment stage. This results in three prints each marked with different set of metal complex markers and a control.

The treated sheets were analyzed for metals in the following way. 3×3 cm samples of the sheets were treated in separate 10 ml aliquots of 10% nitric acid for about 16 hours (overnight).

Each solution was then analyzed for strontium, chromium, vanadium, and nickel by Inductively Coupled Plasma Optical Emission Spectroscopy. After analysis and appropriate calculations the following amounts of each metal were found (results in $mg/m^2$).

| Additive ID | Strontium | Chromium | Vanadium | Nickel |
|---|---|---|---|---|
| none | <0.05 | <0.05 | <0.05 | <0.05 |
| A | 0.33 | 0.32 | <0.05 | 0.17 |
| B | 0.33 | 0.30 | <0.05 | <0.05 |
| C | 0.28 | <0.05 | <0.05 | <0.05 |

from the results it was possible to detect qualitatively which sheets of paper had been treated with which stabilizer. The control sheet had metals less than the detectable limit of the experiment. No vanadium was detected in the test—another control as none was added. If this method was to be used quantitatively the imbibition and extraction procedures would have to calibrated for each metal as we can see that nickel was either poorly take up or poorly extracted compared to strontium and chromium.

EXAMPLE 2

In order to make detection easier and more specific a number of solutions using a mixture of rare earth metal ions were tried.

These were made up by adding appropriate amount of standard solutions (in nitric acid) to a 10 g/l aqueous solution of tetra-sodium EDTA. The pH of this solution was adjusted to 5.0 with potassium hydroxide solution.

10 ml of this solution was added to 250 ml stabilizer and the samples and analyses were carried out as in the first example. The table below shows the initial calculated concentrations of rare earth metal ions in the stabilizer and the concentrations detected in the prints.

| | Conc. In Stabilizer ppm | | | | Found in Paper $mg/m^2$ | | | |
|---|---|---|---|---|---|---|---|---|
| ID | Sr | Y | Yb | Eu | Sr | Y | Yb | Eu |
| Blank | — | — | — | — | 0.27 | nd | nd | nd |
| D | — | 4.0 | 4.0 | — | 0.27 | 0.68 | 0.64 | nd |
| E | — | — | 4.0 | 4.0 | 0.28 | nd | 0.92 | 0.80 |
| F | — | 4.0 | — | 4.0 | 0.27 | 0.79 | nd | 0.88 |

NB. nd = not detected

The results show that there is strontium in the original paper. They also show that the added metal ions in the stabilizer are detected in the paper.

Other methods of detecting could be a scanning electron microscope, by secondary electron emission spectroscopy or by atomic absorption.

It will be understood that these are examples only and that any appropriate detection method may be used.

By using the above described method it is shown to be possible to identify whether or not a print or film has been processed with a particular unique chemistry. Thus if the unique chemistry is associated with a particular authorized site it is possible to determine whether or not the print or film has been processed at this authorized site and therefore if it has been processed with the copyright owner's permission. The process gives the resulting print a unique identification.

The invention can be used with any output media, including prints, motion picture film or reversal prints. The invention could also be used for input media such as a film negative, particularly a motion picture film internegative.

It is to be understood that various modifications and changes may be made without departing from the present invention, the present invention being defined by the following claims.

What is claimed is:

1. A method of processing a photographic material in which at least one of the processing solutions includes one or more chemical compounds which are at least partially retained in the material after processing is complete, the structure and composition of the compounds being unique to a particular process used by a particular copyright owner, the method including the steps of detecting the presence or absence of the unique compounds in the processed material, the composition of any unique compounds present then being compared to an expected composition of these compounds.

2. A method as claimed in claim 1 wherein the chemical compounds are included in the stabilizer solution.

3. A method as claimed in claim 1 wherein the chemical compounds are included in the wash solution.

* * * * *